US005805186A

United States Patent [19]

Yoshida et al.

[11] Patent Number: 5,805,186

[45] Date of Patent: Sep. 8, 1998

[54] INK JET HEAD

[75] Inventors: Naoto Yoshida; Hiroshi Shibata, both of Fukuoka; Mitsuhide Matsuda, Fukuoka-ken; Takuma Takasu, Fukuoka, all of Japan

[73] Assignee: Matsushita Electric Industrial Co., Ltd., Osaka, Japan

[21] Appl. No.: 931,260

[22] Filed: Sep. 16, 1997

Related U.S. Application Data

[63] Continuation of Ser. No. 518,172, Aug. 23, 1995, abandoned.

[30] Foreign Application Priority Data

Sep. 7, 1994 [JP] Japan ..... 6-213686

[51] Int. Cl.[6] ..... B41J 2/05

[52] U.S. Cl. ..... 347/61; 347/64

[58] Field of Search ..... 347/61, 64, 47, 347/56, 54, 20, 1, 63

[56] References Cited

U.S. PATENT DOCUMENTS

| | | | |
|---|---|---|---|
| 3,179,042 | 4/1965 | Nalman | 101/494 |
| 4,595,938 | 6/1986 | Conta et al. | 347/55 |
| 5,400,061 | 3/1995 | Horio et al. | 347/55 |
| 5,455,998 | 10/1995 | Miyazono et al. | 347/61 |

FOREIGN PATENT DOCUMENTS

| | | | |
|---|---|---|---|
| 61-59911 B2 | 5/1979 | Japan . | |
| 59-2619 B2 | 5/1980 | Japan . | |
| 58-38110 B2 | 12/1980 | Japan . | |
| 363209944 | 8/1988 | Japan | 347/61 |
| 63-54547 B2 | 10/1988 | Japan . | |
| 405031897 | 2/1993 | Japan | 347/61 |

*Primary Examiner*—Benjamin R. Fuller
*Assistant Examiner*—Juanita Stephens
*Attorney, Agent, or Firm*—Stevens, Davis, Miller & Mosher, L.L.P.

[57] ABSTRACT

A pair of opposed electrodes are formed on a circuit substrate by photolithography, and an insulation film is formed on the circuit substrate to cover said electrodes therewith. An opening is formed through the insulation film in such a manner that areas of exposure of the pair of electrodes through the opening are substantially equal to each other. A nozzle fluid passage substrate, having a nozzle and a pressure chamber communicating with the nozzle, is placed on the circuit substrate through an adhesive layer in such a manner that the pressure chamber is disposed substantially coaxially with the opening. Then, the circuit substrate and the nozzle fluid passage substrate are bonded together through the adhesive layer by application of heat and pressure, thereby producing a ink jet head for a printer.

9 Claims, 4 Drawing Sheets

INK JET HEAD

BACKGROUND OF THE INVENTION

This application is a continuation of application Ser. No. 08/518,172, filed on Aug. 23, 1995 (abandoned).

FIELD OF THE INVENTION

This invention relates to an ink jet head for use in an ink jet printer, a facsimile printer and the like, in which electrically-conductive ink is energized to be boiled, so that the conductive ink is ejected from a nozzle by pressure produced by this boiling, thereby effecting printing.

DESCRIPTION OF THE RELATED ART

Recently, with the spread of office automation, printers have been extensively used. An ink jet printer produces low noises because it is of a non-impact type, and effects printing at high speed. Therefore, ink jet printers have now attracted attention. Particularly, ink jet printers of the on-demand type have been widely used since they are simple in construction, and are inexpensive.

Various methods of ejecting ink have been used in ink jet printers of the on-demand type. Representative examples include a method utilizing a mechanical displacement pressure produced by a piezoelectric element (see, for example, Japanese Patent Examined Publication Nos. 59-2619 and 58-38110), a method in which ink is heated and boiled by a heating resistance element to produce pressure by which the ink is ejected (see, for example, Japanese Patent Examined Publication Nos. 61-59911 and 63-54547), and a method in which conductive ink is directly energized to be heated for evaporation, or a pressure produced by boiling the ink is utilized for ejecting the ink (see, for example, U. S. Pat. Nos. 3,179,042 and 4,595,938).

The above energization-heating method does not require any particular element for producing the pressure whereas the other two methods need such an element, and this energization-heating system is of a simple construction in which it is only necessary to provide a pair of electrodes disposed in opposed relation to each other. Therefore, the energization-heating method has an advantage that the whole of the head including a fluid passage can be constructed quite easily.

A conventional ink jet head will now be described. FIG. 8 is a plan view of a portion of the conventional ink jet head, showing one nozzle, and FIG. 9 is a cross-sectional view of a portion of the conventional ink jet head taken along the line A—A of FIG. 8. In FIGS. 8 and 9, the ink jet head comprises a substrate 1 of glass, Si or the like on which a pair of electrodes 2*a* and 2*b*, as well as lead wires 3 for connecting the pair of electrodes 2*a* and 2*b* to a signal producing device 10, are formed in predetermined patterns by a semiconducting process such as sputtering, and a nozzle fluid passage substrate 7 of a polyimide film or the like bonded to the substrate 1 by an adhesive layer 8. The nozzle fluid passage substrate 7 includes a pressure chamber 4 filled with electrically-conductive ink, a nozzle 5, and an ink flow passage 6.

The operation of the ink jet head of the above construction will now be described. When voltage is applied to the pair of electrodes 2*a* and 2*b* by the signal producing device 10, electric current flows in the conductive ink having a predetermined volume resistivity. The conductive ink is heated by this electric current to high temperatures, and finally boils to produce bubbles. The pressure of the conductive ink within the pressure chamber 4 is abruptly increased by these bubbles, so that droplets 11 of the conductive ink are ejected from the nozzle 5 to deposit on recording paper 12 to form dots thereon. When the boiling begins, the signal producing device 10 ceases to apply voltage to the electrodes 2*a* and 2*b*. The conductive ink is consumed due to the formation of the dots by the expanded bubbles, and then the pressure chamber 4 is replenished with conductive ink through the ink flow passage 6 before subsequent voltage is applied to the electrodes 2*a* and 2*b*. This sequential operation is repeated, and droplets 11 of the conductive ink are formed continuously, so that successive, desired dots are formed on the recording paper 12.

In the above conventional construction, however, when the nozzle fluid passage substrate 7 is to be bonded to the substrate 1, the former can not be easily positioned with respect to the latter since the nozzle fluid passage substrate 7 is in the form of a film, and hence it is likely to deform. As a result, it has been difficult to make the contact areas of the pair of electrodes 2*a* and 2*b* with respect to the conductive ink, equal to each other. Thus, the contact area of the electrode 2*a* to the conductive ink is different from the contact area of the electrode 2*b* to the conductive ink, and accordingly, bubbles are produced by electrolysis, and the electric current is concentrated on that electrode having the smaller contact area. Thus, an unbalanced electrode consumption occurs, which causes a problem such as a failure in ink ejection has been. And moreover, it is technically difficult to make the contact areas of the pair of electrodes 2*a* and 2*b* with respect to the conductive ink equal to each other, and therefore the yield rate has been lowered, and the manufacturing process has been complicated, which has resulted in a problem of increased cost.

SUMMARY OF THE INVENTION

The present invention is devised in order to solve the above-mentioned problems, and accordingly, an object of this invention is to provide an ink jet head in which the contact areas of a pair of electrodes with respect to conductive ink are substantially equal to each other so as to suppress the formation of bubbles and the dissolution of the electrodes, and also a manufacturing process is simplified so as to reduce time and labor required for the manufacture.

According to the present invention, there is provided an ink jet head having an insulation film with which a pair of electrodes are covered, the insulation film having formed therethrough with an opening in such a manner that contact areas of the pair of electrodes with respect to conductive ink through the opening are substantially equal to each other.

DESCRIPTION OF THE PREFERRED EMBODIMENT

Figure 1:
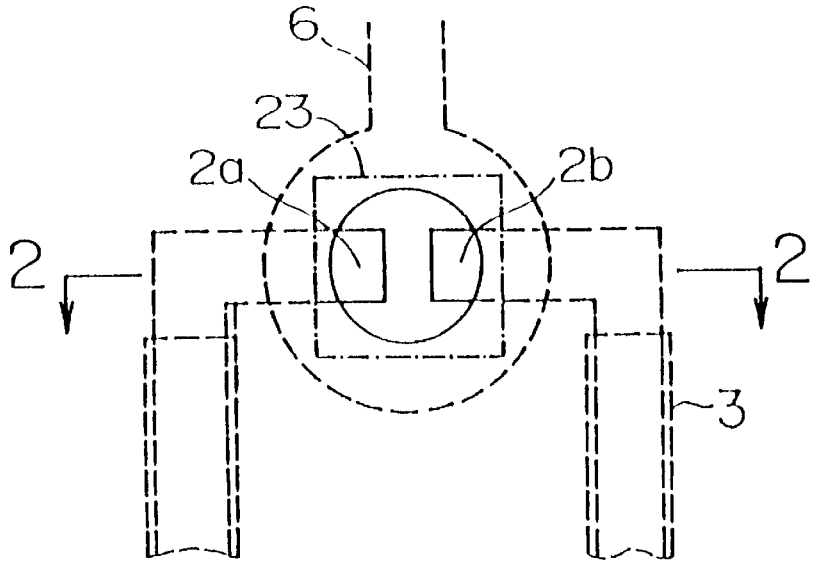
FIG. 1 is a plan view illustrating a portion of an ink jet head of the present invention.
Figure 2:
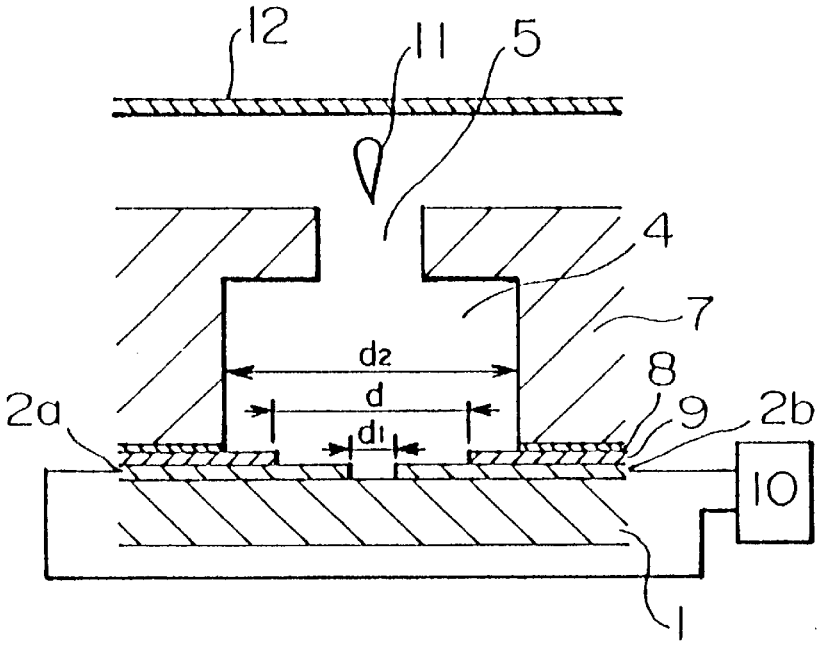
FIG. 2 is a cross-sectional view illustrating a portion of the ink jet head taken along the line B—B of FIG. 1.

A preferred embodiment of the present invention will now be described with reference to the drawings. FIG. 1 is a plan view which shows a portion of one preferred embodiment of an ink jet head of the invention, and FIG. 2 is a cross-sectional view which shows the ink jet head taken along the line B—B of FIG. 1. Referring to FIGS. 1 and 2, the ink jet head comprises a substrate (electric circuit substrate) 1 made of glass, Si or the like on which a pair of electrodes 2*a* and 2*b*, lead wires 3 and an insulation film 9 having an opening 23 are formed by a semiconductor manufacturing process, and a nozzle fluid passage substrate 7 made of a polyimide film or the like bonded to the substrate 1 by an adhesive layer 8. The nozzle fluid passage substrate 7 includes a pressure chamber 4, a nozzle 5 and an ink flow passage 6. Reference numeral 10 denotes a signal producing device 10 for applying a voltage to the electrodes 2*a* and 2*b* through the lead wires 3, reference numeral 11 a droplet of electrically-conductive ink ejected from the nozzle 5, and reference numeral 12 recording paper.

Figure 3:
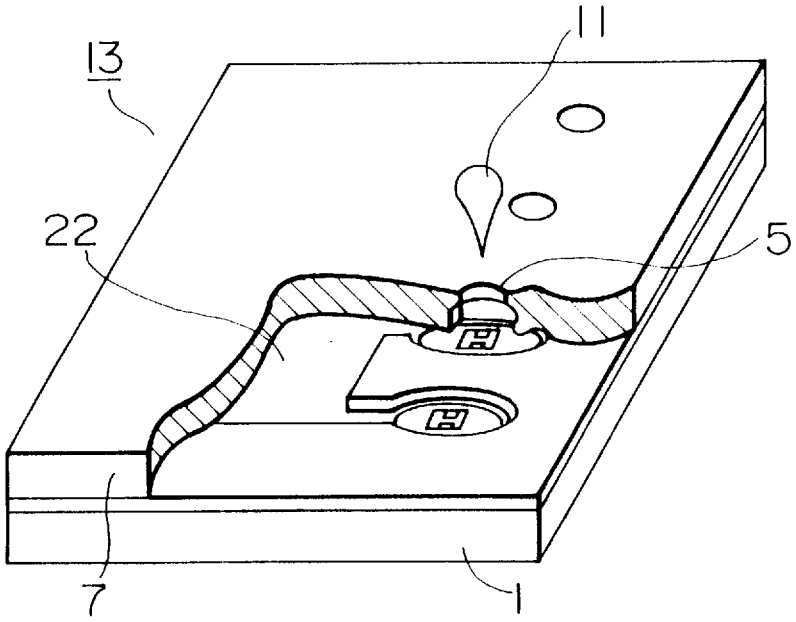
FIG. 3 is a partly-broken, perspective view illustrating the ink jet head.
Figure 4:
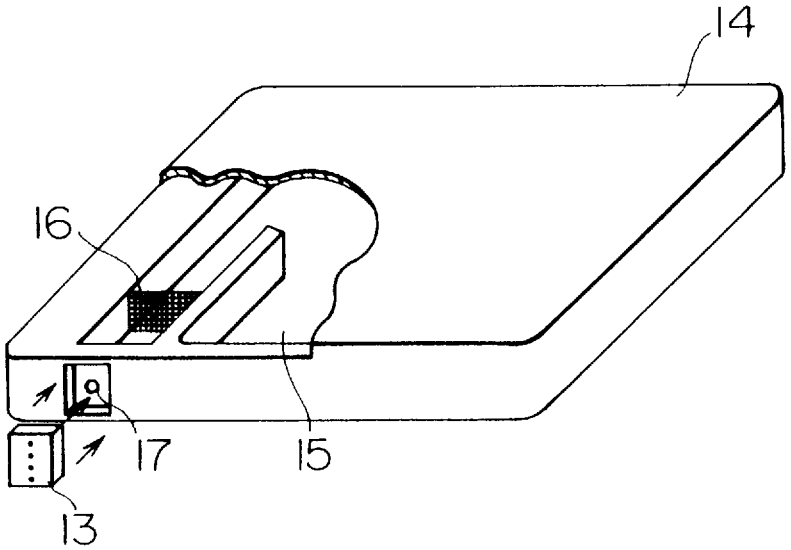
FIG. 4 is a partly-broken, perspective view illustrating a head cartridge having the ink jet head mounted thereon.

FIG. 3 is a partly-broken, perspective view which shows the ink jet head in this embodiment, and reference numeral 13 denotes a head base, and reference numeral 22 denotes a common ink chamber. FIG. 4 is a partly-broken, perspective view which shows a head cartridge having the ink jet head in this embodiment mounted thereon. This head cartridge includes an ink cartridge 14 on which the head base 13 is adapted to be attached, an ink tank 15 formed in the ink cartridge 14, an ink filter 16 for removing dirt and dust from ink fed from the ink tank 15, and an ink feed port 17 for feeding the ink to the common ink chamber 22 shown in FIG. 3.

Figure 5:
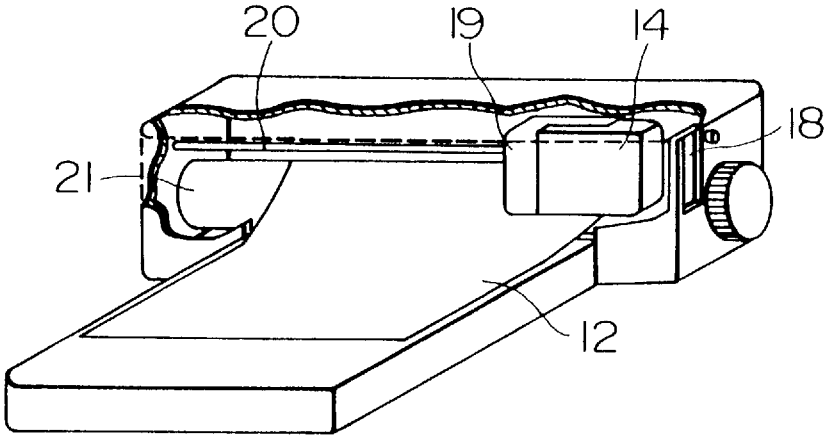
FIG. 5 is a partly-broken, perspective view illustrating an ink jet printer having the head cartridge mounted thereon.

FIG. 5 is a partly-broken, perspective view which shows an ink jet printer having the ink jet head in this embodiment mounted thereon. This ink jet printer includes a cartridge insertion hole 18 for inserting the ink cartridge 14 into the printer, a carriage 19 for fixedly holding the inserted ink cartridge 14, a guide shaft 20 for guiding reciprocal movement of the carriage 19 therealong, and a platen roller 21 for feeding the recording paper 12.

A method of manufacturing the ink jet head in this embodiment having the above construction will now be described. First, a thin film made of Ti having a thickness of about 2 $\mu$m is formed on the substrate 1 by DC sputtering. Then, a pattern for the electrodes 2*a* and 2*b* is formed on the Ti film by photolithography, and the Ti film except for that portion thereof having the pattern for the electrodes 2*a* and 2*b* is removed by etching, thereby forming the electrodes 2*a* and 2*b*. Then, an Au film having a thickness of about 1 $\mu$m is formed on the substrate 1 by vapor deposition, and then a pattern for the lead wires 3 is formed on the Au film by photolithography, and the Au film except for that portion thereof having the pattern for the lead wires 3 is removed by etching, thereby forming the lead wires 3. Then, the insulation film 9 of a photosensitive resin having a thickness of about 4 $\mu$m is coated onto the substrate 1. Then, masking is applied to the insulation film 9 over the electrodes 2*a* and 2*b* except for their opposed end portions, and then the insulation film 9 is subjected to exposure in such a manner that areas of exposure of the pair of electrodes 2*a* and 2*b* to the exterior through the opening 23 to be formed are substantially equal to each other, and that a width d of the opening 23 to be formed can be larger than the distance $d_1$ between the pair of electrodes 2*a* and 2*b*, and is smaller than a width d2 of the pressure chamber 4. Then, that portion of the photosensitive resin with which the opposed end portions of the electrodes 2*a* and 2*b* are covered is removed by a developing solution to form the opening 23 in the insulation film 9. Then, the substrate is rinsed with isopropyl alcohol. Then, the substrate 1 is calcined at 400° in an electric furnace. The thickness of the insulation film 9 after calcination is about 2 $\mu$m. Here, photosensitive polyimide is used as the photosensitive resin.

The pressure chamber 4, the nozzle 5 and the ink flow passage 6 are formed in the nozzle fluid passage substrate 7, using an excimer laser.

Then, the nozzle fluid passage substrate 7 is placed on the substrate 1, formed by the above steps, through the adhesive layer 8, and is bonded thereto by application of heat and pressure. At this time, the contact areas of the electrodes 2*a* and 2*b* with respect to the conductive ink have already been defined by the opening 23 formed in the insulation film 9, and therefore much accuracy is not required for the positioning of the nozzle fluid passage substrate 7, and hence this positioning can be effected easily.

In the above embodiment, although photosensitive polyimide is used for forming the insulation film 9, other photosensitive resins, such as photosensitive acrylic resin, rubber-type resist, novolak resin, positive resist, photosensitive glass, may be used. Also, there may be used a method in which the insulation film 9 is formed by sputtering of $SiO_2$, $Al_2O_3$ or the like, and then after the necessary pattern is formed using a resist, the opening 23 is formed in the insulation film 9 by etching or the like.

As described above, in the ink jet head of the above embodiment, the contact areas of the pair of electrodes 2*a* and 2*b* with respect to the conductive ink can be made equal to each other by the opening 23 in the insulation film 9, and therefore the formation of bubbles and the dissolution of the electrodes 2*a* and 2*b* during the printing operation are suppressed. And moreover, since high accuracy is not required for the positioning of the substrate 1 and the nozzle fluid passage substrate 7 with respect to each other, the manufacturing process is easy, so that time and labor required for the manufacture can be reduced.

Figure 6:
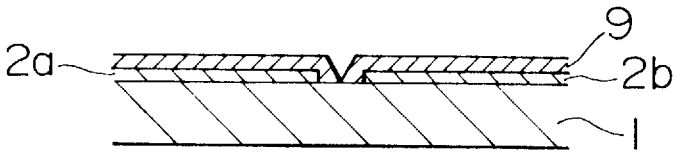
FIG. 6 is a cross-sectional view illustrating a portion of an ink jet head of the invention in which a width of an opening in an insulation film is smaller than the distance between a pair of electrodes.
Figure 7:
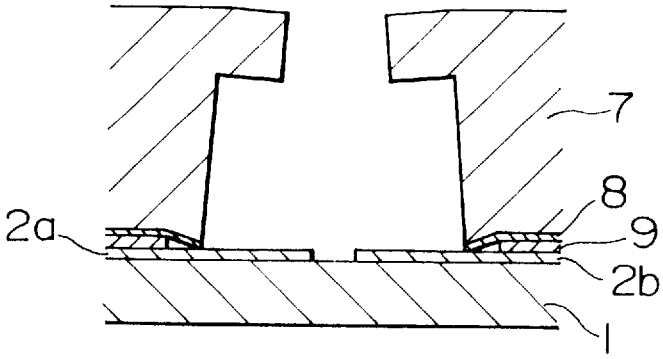
FIG. 7 is a cross-sectional view illustrating a portion of an ink jet head of the invention in which a width of an opening in an insulation film is larger than a width of a pressure chamber.
Figure 8:
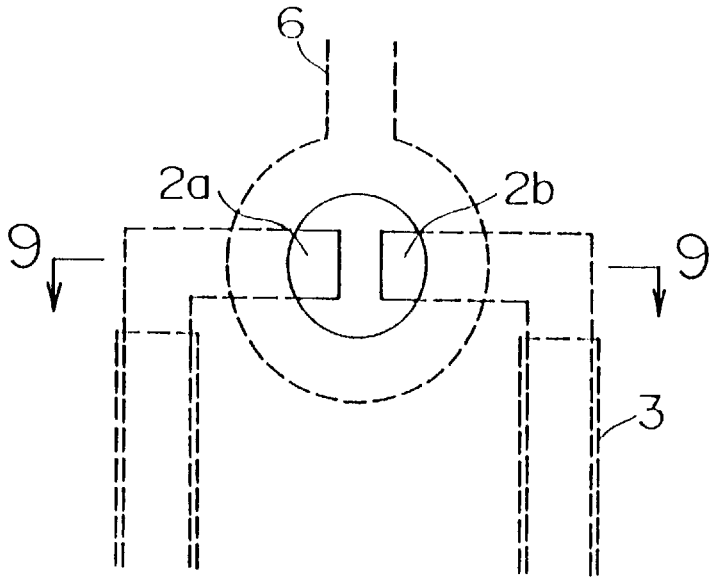
FIG. 8 PRIOR ART
FIG. 8 is a plan view illustrating a portion of a conventional ink jet head, showing one nozzle.
Figure 9:
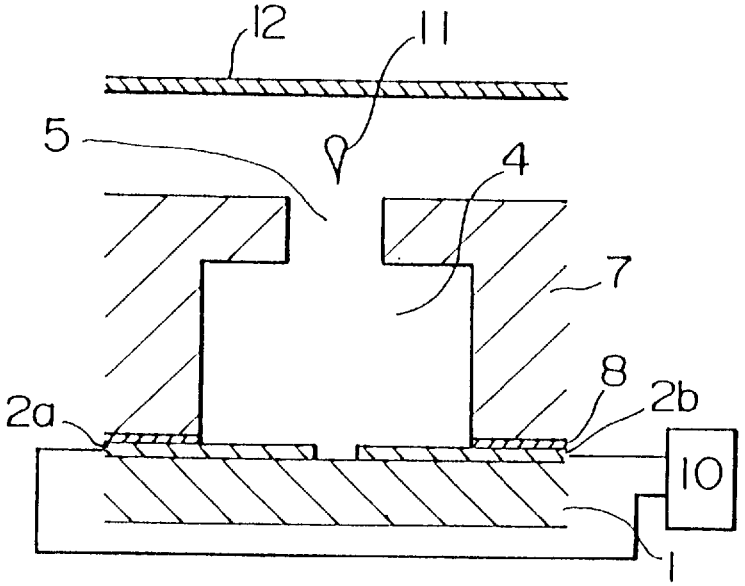
FIG. 9 PRIOR ART
FIG. 9 is a cross-sectional view illustrating a portion of the conventional ink jet head, taken along the line A—A of FIG. 8.

Should the width d of the opening 23 in the insulation film 9 be smaller than the distance dl between the pair of electrodes 2*a* and 2*b*, the electrodes 2*a* and 2*b* would be completely covered with the insulation film 9 as shown in FIG. 6, and accordingly, the conductive ink could not be energized. Also, should the width d of the opening 23 be larger than the width d2 of the pressure chamber 4, the nozzle fluid passage substrate 7 would be deformed by the pressure applied for bonding the nozzle fluid passage substrate 7 to the substrate 1 since this substrate 7 is in the form of a film (see FIG. 7), or the adhesive layer 8 is squeezed out by this pressure. The result is that the contact areas of the pair of electrodes 2*a* and 2*b* with respect to the conductive ink differ from each other, thus causing the formation of bubbles and the dissolution of the electrodes 2*a* and 2*b*. If the pressure for effecting the bonding is reduced so as to prevent the deformation of the nozzle fluid passage substrate 7 and the squeeze-out of the adhesive layer 8, the intimate bonding between the insulation film 9 and the nozzle fluid passage substrate 7 is deteriorated, resulting in a possibility that the nozzle fluid passage substrate 7 is separated from the substrate 1 when the ink is ejected from the nozzle.

Therefore, the conductive ink can be boiled in a stable manner by making the width d of the opening 23 in the insulation film 9 larger than the distance d1 between the pair of electrodes 2*a* and 2*b*, and also the intimate bonding between the insulation film 9 and the nozzle fluid passage substrate 7 can be achieved by making the width d of the opening 23 smaller than the width d2 of the pressure chamber 4, so that the conductive ink can be ejected stably over a prolonged period of time.

There were prepared ink jet heads (samples) of the invention as described in the above embodiment, which had respective insulation films 9 having respective thicknesses of 0.5 μm, 0.8 μm, 1.0 μm, 2.0 μm and 5.0 μm, and the number of ink ejections during the lifetime for each ink jet head was examined. The number of ejections during the lifetime was defined in terms of the number of dots formed on recording paper. As to test conditions, the applied voltage was 25 V, the frequency of the applied voltage was 3 MHz, and a volume resistivity of ink was 30 Ω·cm. Results of the tests are shown in Table 1 below.

TABLE 1

| | Film thickness (μm) | Ejections during lifetime (Dots) |
|---|---|---|
| Sample 1 | 5.0 | more than two hundred million |
| Sample 2 | 2.0 | more than two hundred million |
| Sample 3 | 1.0 | one hundred million |
| Sample 4 | 0.8 | fifty million |
| Sample 5 | 0.5 | twenty million |

As is clearly understood from Table 1, in those ink jet heads (samples) having the insulation film 9 with a thickness of not less than 1 μm, the number of ejections (or dots) during the lifetime was not less than one hundred million, and thus those ink jet heads proved practical. On the other hand, those ink jet heads (samples) having the insulation film 9 with a thickness of less than 1 μm were not suited for practical use because of their shorter lifetime. With respect to Sample 4 and Sample 5 having the insulation film 9 with a thickness of less than 1 μm, it is thought that the insulation film 9 on the Ti film (constituting the electrodes 2*a* and 2*b*) was destroyed by heat and cavitation which was produced when the conductive ink was boiled, so that the contact areas of the pair of electrodes 2*a* and 2*b* with the conductive ink differed from each other, thereby causing the formation of bubbles and the dissolution of the electrodes, thus resulting in a failure in ink ejection.

As described above, by making the thickness of the insulation film 9 not less than 1 μm, the insulation film 9 can be prevented from being destroyed by heat and cavitation developing during the boiling of the ink, thereby prolonging the ejection lifetime.

What is claimed is:

1. An ink jet head comprising:

a pressure chamber adapted to be filled with electrically-conductive ink and having a width (d2);

a nozzle communicating with said pressure chamber;

a pair of electrodes exposed inside said pressure chamber and spaced apart from each other by a distance, for energizing said conductive ink so as to boil said conductive ink in order to eject said conductive ink from said nozzle by pressure produced by boiling, thereby effecting printing, said pressure chamber being defined between said nozzle and said pair of electrodes; and an insulation film disposed between said pressure chamber and said pair of electrodes and partially covering said pair of electrodes, said insulation film having an opening formed therethrough and having a width (d) smaller than that of said pressure chamber.

2. An ink jet head according to claim 1, in which a width of said opening in said insulation film along a line passing through centers of opposed end surfaces of said pair of electrodes is smaller than a width of said pressure chamber, and is larger than the distance between said pair of electrodes.

3. An ink jet head according to claim 1, in which said insulation film is made of a photosensitive resin.

4. An ink jet head according to claim 1, in which said opening in said insulation film is formed by etching.

5. An ink jet head comprising:

a pressure chamber adapted to be filled with electrically-conductive ink and having a width (d2);

a nozzle communicating with said pressure chamber;

a pair of electrodes exposed inside said pressure chamber and spaced apart from each other by a distance, for energizing said conductive ink to boil said conducting ink, so that said conductive ink is ejected from said nozzle by a pressure produced by said boiling, thereby effecting printing, said pressure chamber being defined between said nozzle and said pair of electrodes; and an insulating film disposed between said pressure chamber and said pair of electrodes and partially covering said pair of electrodes, said insulation film having an opening formed therethrough and having a width (d) smaller than that of said pressure chamber wherein said pair of electrodes contact said conductive ink through said opening, said insulation film having a thickness of not less than 1 μm.

6. An ink jet head comprising:

a pressure chamber adapted to be filled with electrically-conductive ink and having a width (d2);

a nozzle communicating with said pressure chamber;

a pair of electrodes disposed inside said pressure chamber and spaced apart from each other by a distance, for energizing said conductive ink to boil said conducting ink, so that said conductive ink is ejected from said nozzle by a pressure produced by said boiling, thereby effecting printing, said pressure chamber being defined between said nozzle and said pair of electrodes; and an insulation film with which said pair of electrodes are covered, said insulation film having a thickness of not less than 1 μm and being disposed between said pressure chamber and said pair of electrodes, said insulation film having an opening formed therethrough and having a width (d) which is smaller than that of said pressure chamber.

7. An ink jet head according to claim 6, in which a width of said opening in said insulation film along a line passing through centers of opposed end surfaces of said pair of electrodes is smaller than a width of said pressure chamber, and is larger than the distance between said pair of electrodes.

8. An ink jet head comprising:

a first substrate having a pair of electrodes mounted thereon and spaced apart from each other by a distance;

a nozzle fluid passage substrate having a recess cooperating with said first substrate to form a pressure chamber adapted to be filled with electrically-conductive ink, said nozzle fluid passage substrate having a nozzle, and said pair of electrodes energizing said conductive ink so as to boil said conductive ink in order that said conductive ink is ejected from said nozzle by a pressure produced by boiling, thereby effecting printing, said pressure chamber being defined between said nozzle and said pair of electrodes; and an insulation film disposed between said first substrate and said nozzle fluid passage substrate, said insulation film having a thickness of not less than 1 $\mu$m and having a width (d) smaller than that of said pressure chamber, and said insulation film having an opening formed therethrough.

9. An ink jet head according to claim 8, in which a width of said opening in said insulation film along a line passing through centers of opposed end surfaces of said pair of electrodes is smaller than a width of said pressure chamber, and is larger than the distance between said pair of electrodes.

* * * * *